US007648421B2

(12) United States Patent
Yoon

(10) Patent No.: US 7,648,421 B2
(45) Date of Patent: Jan. 19, 2010

(54) CHIPPING NET

(76) Inventor: William Young Yoon, 2222 Thistle Rd., Glenview, IL (US) 60026

( * ) Notice: Subject to any disclaimer, the term of this patent is extended or adjusted under 35 U.S.C. 154(b) by 0 days.

(21) Appl. No.: 12/030,582

(22) Filed: Feb. 13, 2008

(65) Prior Publication Data

US 2008/0194350 A1 Aug. 14, 2008

(51) Int. Cl.
*A63B 69/36* (2006.01)

(52) U.S. Cl. ..... 473/197; 273/400

(58) Field of Classification Search ..... 273/398–402; 473/476–478, 197

See application file for complete search history.

(56) References Cited

U.S. PATENT DOCUMENTS

| | | | | |
|---|---|---|---|---|
| 3,264,001 | A | 8/1966 | Urban | |
| 4,825,892 | A | 5/1989 | Norman | |
| 5,249,592 | A | 10/1993 | Springer et al. | |
| 5,269,527 | A | 12/1993 | Noval | |
| 5,407,291 | A | 4/1995 | Hazinski et al. | |
| 5,427,381 | A | 6/1995 | Macaluso et al. | |
| 5,433,433 | A | 7/1995 | Armell | |
| 5,452,934 | A | 9/1995 | Zheng | |
| 5,569,094 | A | 10/1996 | Macaluso | |
| D384,382 | S | 9/1997 | Armell | |
| 5,842,940 | A | 12/1998 | Macaluso | |
| 5,845,697 | A | 12/1998 | Zheng | |
| 5,976,023 | A | 11/1999 | Cho | |
| 5,989,130 | A | 11/1999 | Macaluso | |
| D418,883 | S | 1/2000 | Cho | |
| D419,211 | S | 1/2000 | Lanham | |
| 6,135,894 | A | 10/2000 | Cho | |
| 6,247,699 | B1 | 6/2001 | Macaluso | |
| 6,312,343 | B1 | 11/2001 | Cho | |
| 6,530,844 | B2 | 3/2003 | Lin | |
| 6,554,717 | B2 | 4/2003 | Cho | |
| 6,659,466 | B2 * | 12/2003 | Searles et al. | 273/400 |
| 6,736,152 | B2 | 5/2004 | Zheng | |
| 6,939,241 | B1 | 9/2005 | Chang | |
| 7,021,630 | B1 | 4/2006 | Cho | |
| 7,118,487 | B2 | 10/2006 | Turcot | |
| 7,198,274 | B2 | 4/2007 | Cho | |
| 7,264,245 | B2 | 9/2007 | Cho | |
| 7,267,625 | B2 | 9/2007 | Zheng | |
| 2001/0009871 | A1 * | 7/2001 | Cho | 473/197 |
| 2001/0034271 | A1 | 10/2001 | Nozato | |
| 2002/0030324 | A1 | 3/2002 | Macaluso | |
| 2002/0183128 | A1 | 12/2002 | Cho | |
| 2003/0078111 | A1 * | 4/2003 | Wenzler | 473/197 |
| 2003/0224866 | A1 | 12/2003 | Chen | |
| 2007/0144571 | A1 | 6/2007 | Wu et al. | |
| 2007/0187898 | A1 | 8/2007 | Chang | |

* cited by examiner

*Primary Examiner*—Mark S Graham
(74) *Attorney, Agent, or Firm*—Price, Heneveld, Cooper, DeWitt & Litton, LLP

(57) ABSTRACT

A chipping net comprising a resilient but flexible rod formed into a figure eight and folded at a crossing of the figure eight, thereby forming a base loop for placement on a surface below the crossing and a main loop above the crossing. The main loop and the base loop are angled relative to each other, with the angle being less than 90 degrees. The chipping net also includes a net connected to the main loop for receiving golf balls. The force of the rod trying to expand into a circle out of the figure eight forces the main loop away from the base loop.

18 Claims, 8 Drawing Sheets

CHIPPING NET

FIELD OF THE INVENTION

The present invention concerns nets, and more particularly relates to golf chipping nets.

SUMMARY OF THE PRESENT INVENTION

An aspect of the present invention is to provide a chipping net comprising a resilient but flexible rod formed into a figure eight and folded at a crossing of the figure eight, thereby forming a base loop for placement on a surface below the crossing and a main loop above the crossing. The main loop and the base loop are angled relative to each other, with the angle being less than 90 degrees. The chipping net also includes a net connected to the main loop for receiving golf balls. The force of the rod trying to expand into a circle out of the figure eight forces the main loop away from the base loop.

Another aspect of the present invention is to provide a method of providing a chipping net comprising providing a resilient but flexible rod, forming the rod into a figure eight and folding the rod at a crossing of the figure eight, thereby forming a base loop for placement on a surface below the crossing and a main loop above the crossing. The main loop and the base loop are angled relative to each other, with the angle being less than 90 degrees. The method also includes connecting a net to the main loop for receiving golf balls and forcing the main loop away from the base loop with a force of the rod trying to expand into a circle out of the figure eight.

Yet another aspect of the present invention is to provide a chipping net comprising a resilient but flexible rod, a net, a strap, a support rod and a sheath. The rod is formed into a figure eight and folded at a crossing of the figure eight, thereby forming a base loop for placement on a surface below the crossing and a main loop above the crossing. The main loop and the base loop are angled relative to each other, with the angle being less than 90 degrees. The net is connected to the main loop for receiving golf balls. The force of the rod trying to expand into a circle out of the figure eight forces the main loop away from the base loop. The strap is connected to the main loop and the base loop for preventing the main loop and the base loop from expanding the angle to be greater than a predetermined angle. The support rod positively maintains the main loop angled relative to the base loop. The main loop includes a first aperture and the base loop includes a second aperture and the support rod extends through the first aperture and the second aperture. The sheath covers the rod, with the sheath forming a pair of circles and with each circle being connected at the crossing.

These and other aspects, objects, and features of the present invention will be understood and appreciated by those skilled in the art upon studying the following specification, claims, and appended drawings.

BRIEF DESCRIPTION OF THE DRAWINGS

The following brief description of the figures, and the related figures themselves, exemplifies a particular preferred embodiment of the invention constituting the best mode presently contemplated. As will be understood, other embodiments of the invention as well as changes and variations in the particular structure shown in these figures are no doubt possible, and may very well suggest themselves to those skilled in the art after studying this disclosure and these figures.

FIG. 1(*b*) is a front view of the chipping net in accordance with the present invention;

FIG. 2(*b*) is a front view of a rod of the chipping net in accordance with the present invention in a second construction position;

FIG. 2(*c*) is a side view of the chipping net in accordance with the present invention in a third construction position;

DETAILED DESCRIPTION OF PREFERRED EMBODIMENT

Figure 1A:
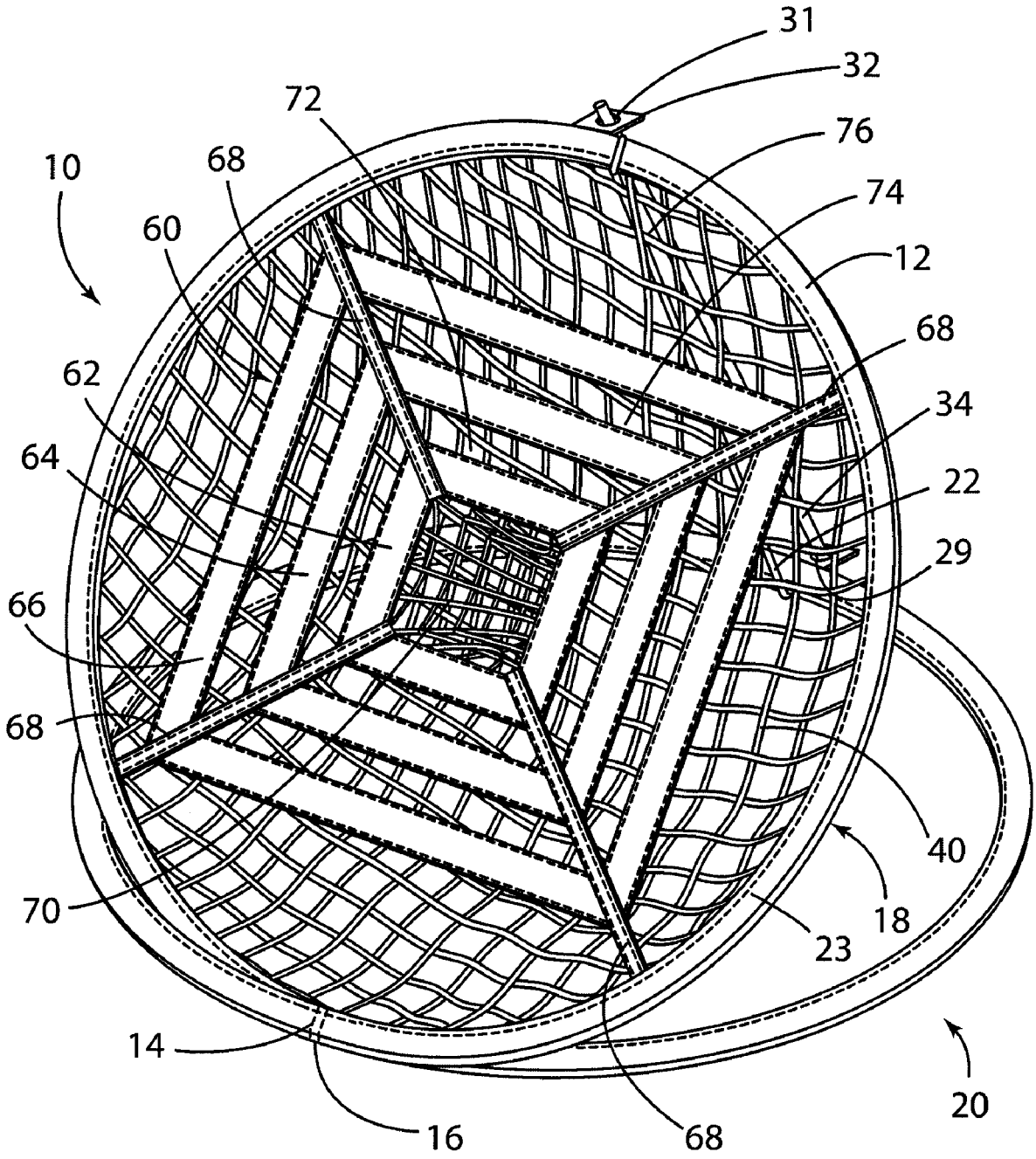
FIG. 1(*a*) is a perspective view of a chipping net in accordance with the present invention.
Figure 1B:
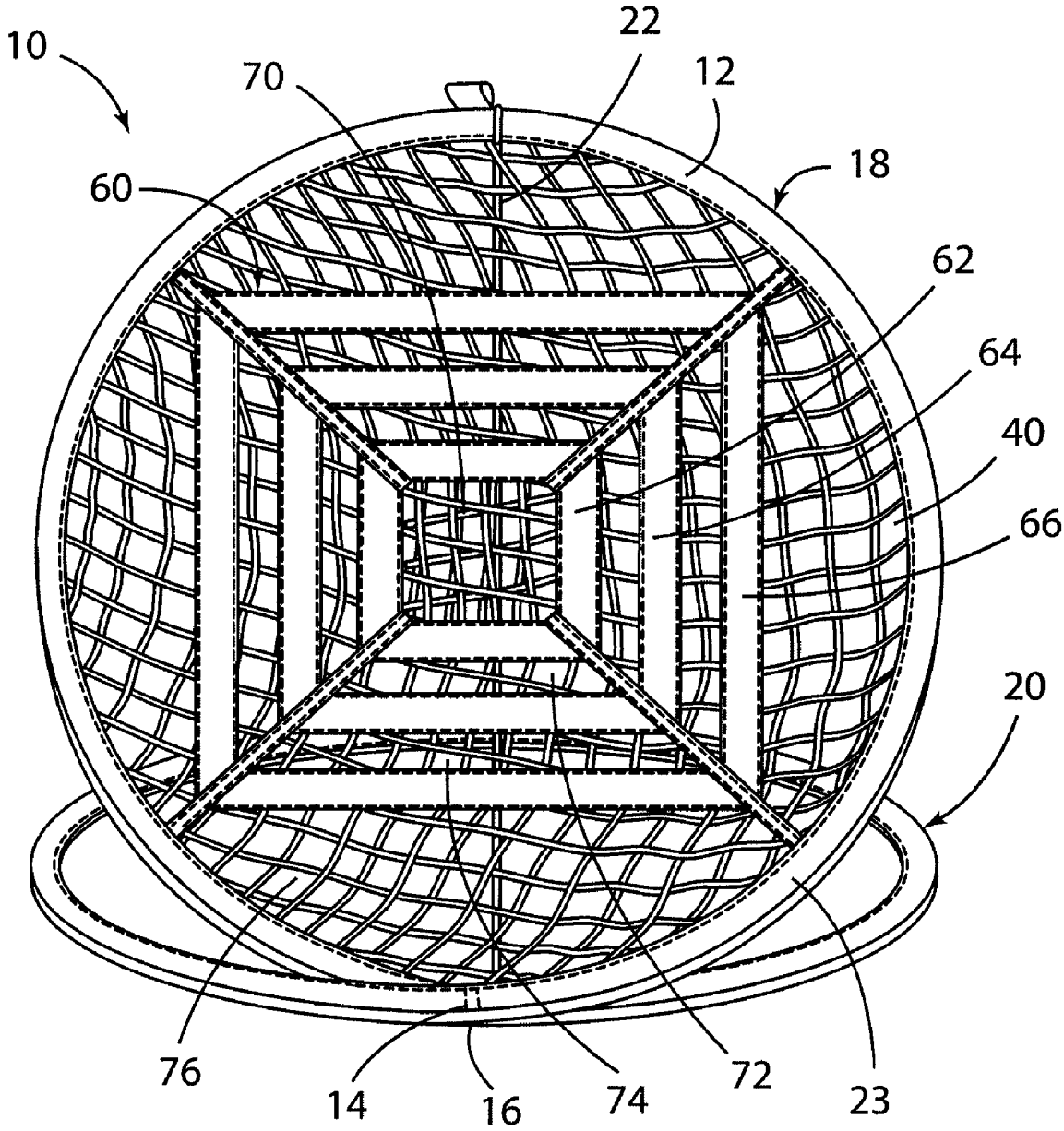

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1(*a*) and 1(*b*)) generally designates a chipping net embodying the present invention. The chipping net 10 comprises a resilient, but flexible rod 12 formed into a figure eight, with a connection member 14 at a crossing 16 of the flexible rod 12 for maintaining the material in the figure eight. The chipping net 10 thereby forms an upper portion 18 above the crossing 16 and a lower portion 20 below the crossing 16. A strap member 22 is connected to the upper portion 18 and the lower portion 20 to bend the upper portion 18 about the crossing 16, with the strap member 22 maintaining the upper portion 18 at an acute angle relative to the lower portion 20. A net 40 is connected to the upper portion 18 and the lower portion 20 is positioned on the ground, thereby allowing the chipping net 10 to receive golf balls into a ring defined by the upper portion 18.

Figure 2:
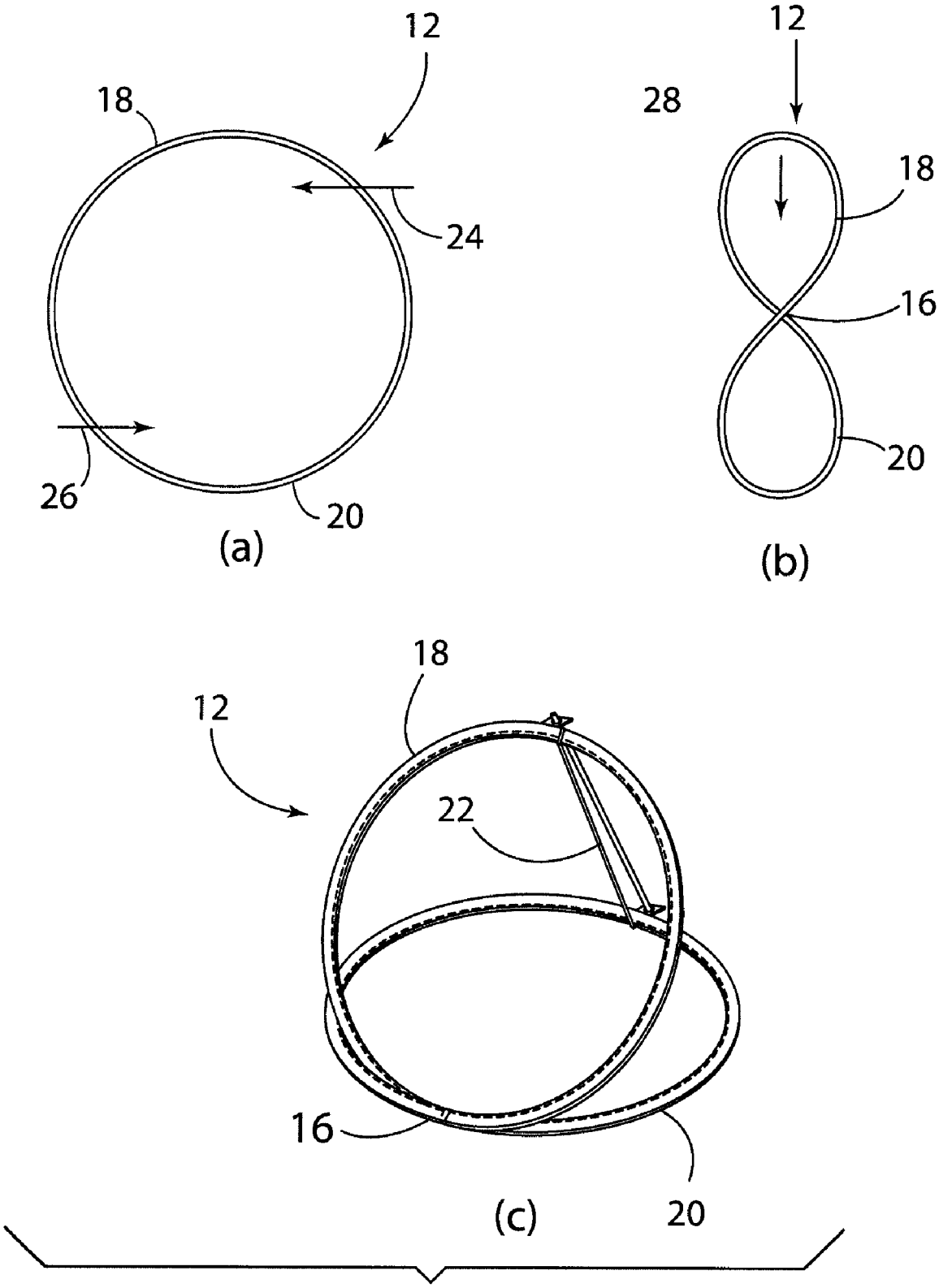
FIG. 2(*a*) is a front view of a rod of the chipping net in accordance with the present invention in a first construction position.

In the illustrated example, the flexible rod 12 is preferably made of flexible metal or plastic wire. The chipping net 10 is formed by first making the flexible rod 12 into a circle as illustrated in FIG. 2(*a*) by connecting the two ends of the flexible rod 12 together. However, the flexible rod 12 preferably includes a sheath 23 covering the flexible rod 12 such that the ends of the flexible rod 12 do not have to be connected together as long as the ends of the sheath 23 are connected together or multiple pieces of the sheath 23 are connected together (e.g., at the crossing 16). The upper portion 18 of flexible rod 12 is formed into a circle and is then rotated in a first direction along arrow 24 in FIG. 2(*a*) and the lower portion 20 of the flexible rod 12 is rotated in a second direction opposite to the first direction along arrow 26 in FIG. 2(*a*), thereby forming the figure eight configuration as shown in FIG. 2(*b*). At this point, the crossing 16 of the flexible rod 12 is connected using the connection member 14 (which can comprise sewing adjacent portions of the sheath 23 together at the crossing 16). The upper portion 18 is then bent about the lower portion 20 at the crossing 16 along arrow 28 in FIG. 2(*b*) and the strap member 22 is connected to the upper portion 18 and the lower portion 20 to maintain the upper portion 18 at an acute angle relative to the lower portion 20 as illustrated in FIG. 2(*c*).

In the illustrated embodiment, the strap member 22 is connected to the upper portion 18 at the point furthest from the crossing 16 and to the lower portion 20 at the point furthest from the crossing 16, although it is contemplated that more than one strap member could be used and that any of the strap members (including a single strap member) could be located at other points along the upper portion 18 and/or the lower portion 20. The resiliency of the flexible rod 12 will bias the upper portion 18 away from the lower portion 20, thereby maintaining the chipping net 10 in an open position as illustrated in FIGS. 1 and 2(*a*). The strap member 22 can include an opening 29 at the point of contact with the lower portion 20 to allow a stake (not shown) to be positioned through the opening 29 to connect the chipping net 10 to the ground. Alternatively, the sheath 23 could include a protection anywhere along the periphery of the lower portion 20 with an opening 29 of accepting the stake therein. It is further contemplated that a supporting pole 34 could be inserted through the opening 29 in the lower portion 20 and through an opening 31 on a projection 32 on the upper portion 18 to positively maintain the chipping net 10 in the open position (with ends of the supporting pole 34 having enlarged flanges such that the ends of the supporting pole 34 can extend through the openings 29 and 31 until the enlarged flanges abut the openings 29 and 31). It is also contemplated that the supporting pole 34 could be collapsible.

The illustrated net 40 is connected to a periphery of the upper portion 18 of the rod 12 and is configured to accept golf balls shot into the chipping net 10 through the upper portion 18. Preferably the net 40 includes openings smaller than a golf ball. It is contemplated that, instead of a net, any other receiving member (e.g., sheet of flexible material) could be used.

In the illustrated example, the chipping net 10 further includes a target 60 in the center of the upper portion 18 of the rod 12. In the embodiment illustrated in FIG. 1, the target 60 comprises three rectangular sheets 62, 64 and 66 connected to four bands 68 of material extending from a periphery of the upper portion 18 of the rod 12 towards the center of the upper portion 18. The innermost rectangular sheet 62 defines a first center opening 70, the middle rectangular sheet 64 defines a second opening 72 between the innermost rectangular sheet 62 and the middle rectangular sheet 64, the outermost rectangular sheet defines a third opening 74 between the middle rectangular sheet 64 and the outermost rectangular sheet 66, and the periphery of the upper portion 18 defines a fourth opening 76 between the outermost rectangular sheet 66 and the periphery of the upper portion 18. A person using the chipping net 10 can determine the accuracy of their chips by which opening 70, 72, 74, 76 the golf ball is chipped through, with a chipped ball going through the first opening 70 being the best chip and a chipped ball going through the fourth opening 76 being the worst chip (except for missing the chipping net entirely).

Figure 3:
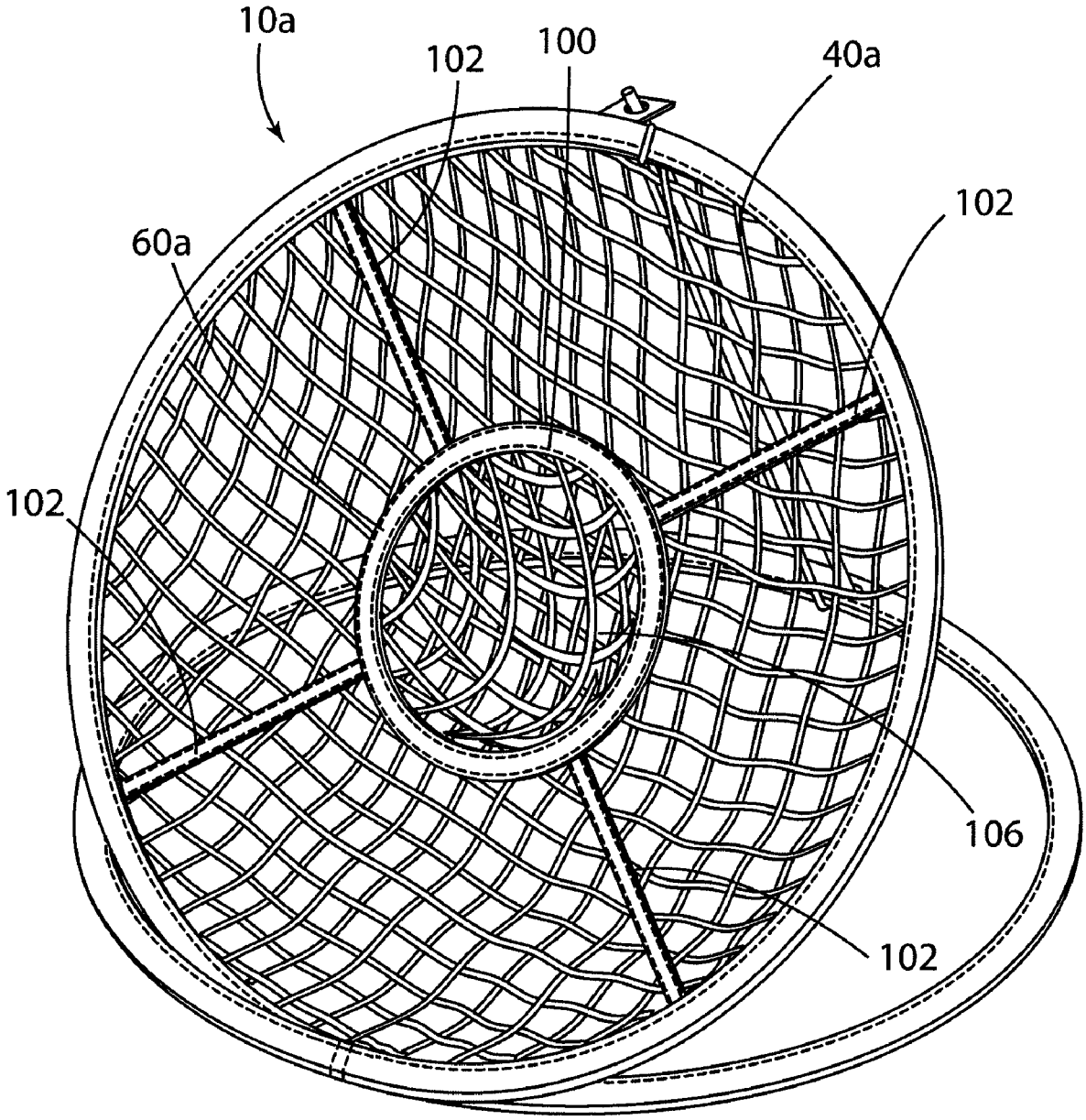
FIG. 3 is a perspective view of a second embodiment of the chipping net in accordance with the present invention.

The reference numeral 10*a* (FIG. 3) generally designates another embodiment of the present invention, having a second embodiment for the chipping net. Since chipping net 10*a* is similar to the previously described chipping net 10, similar parts appearing in FIG. 1 and FIG. 3, respectively, are represented by the same, corresponding reference number, except for the suffix "a" in the numerals of the latter. The chipping net 10*a* is identical to the first embodiment of the chipping net 10, except with a different target 60*a*. In the second embodiment of the chipping net 10*a*, the target 60*a* comprises a center ring 100 connected to the periphery of the upper portion 18 of the rod 12 by at least three belts 102. Although four belts 102 are shown, it is contemplated that any number of belts 102 could be used. The center ring 100 is located in a center of the upper portion 18 and includes a small net 106 connected thereto. Preferably the small net 106 includes openings smaller than a golf ball. It is contemplated that, instead of a net, any other receiving member (e.g., sheet of flexible material) could be used. The illustrated target 60*a* allows a person using the chipping net 10*a* to determine the accuracy of their chips by which net 40*a* or 106 the golf ball is chipped into, with a chipped ball going into the small net 106 being the best chip and a chipped ball going into the net 40*a* being the worst chip (except for missing the chipping net entirely).

Figure 4:
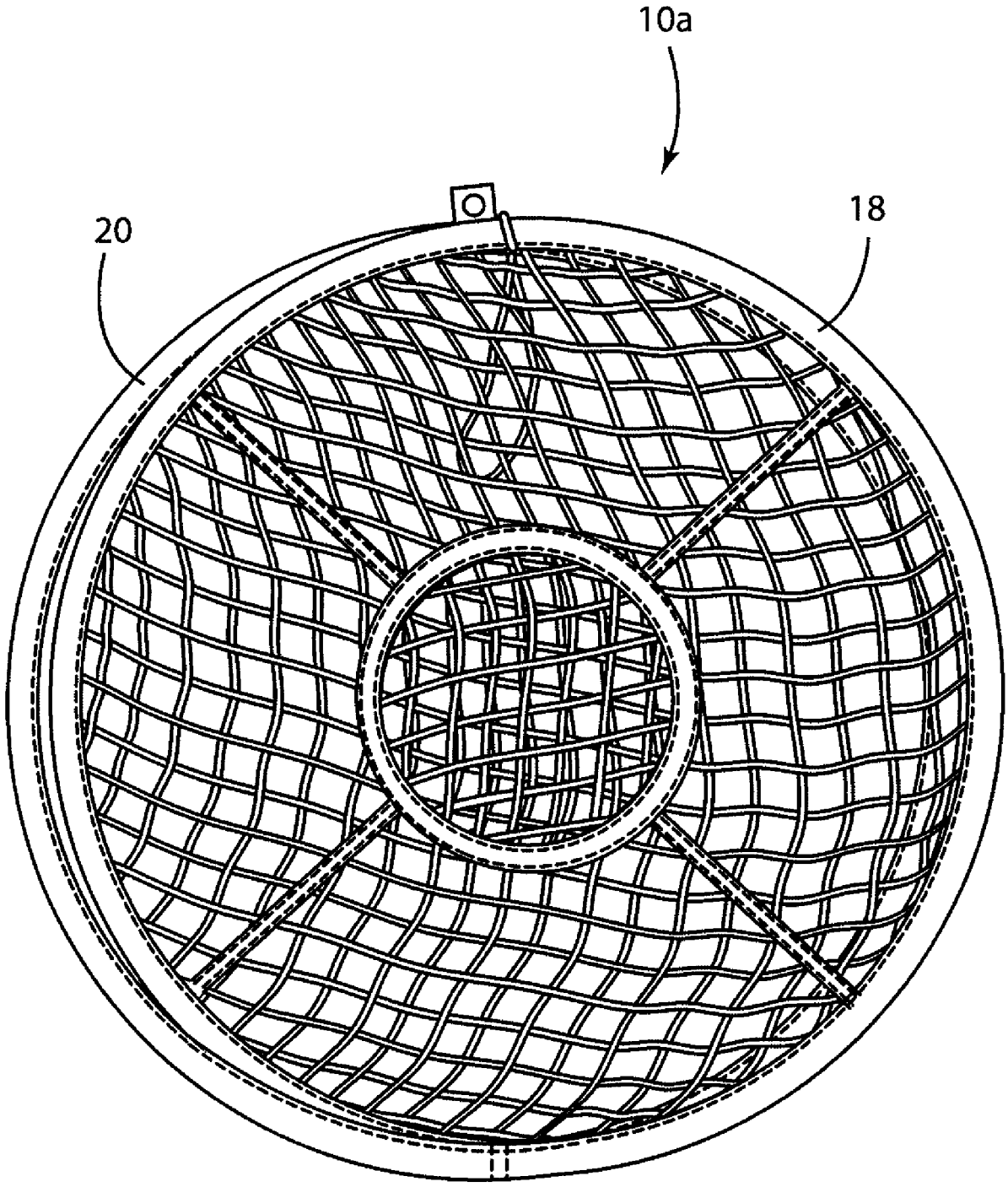
FIG. 4 is a perspective view of the chipping net in accordance with the present invention in a first stowing position.
Figure 5:
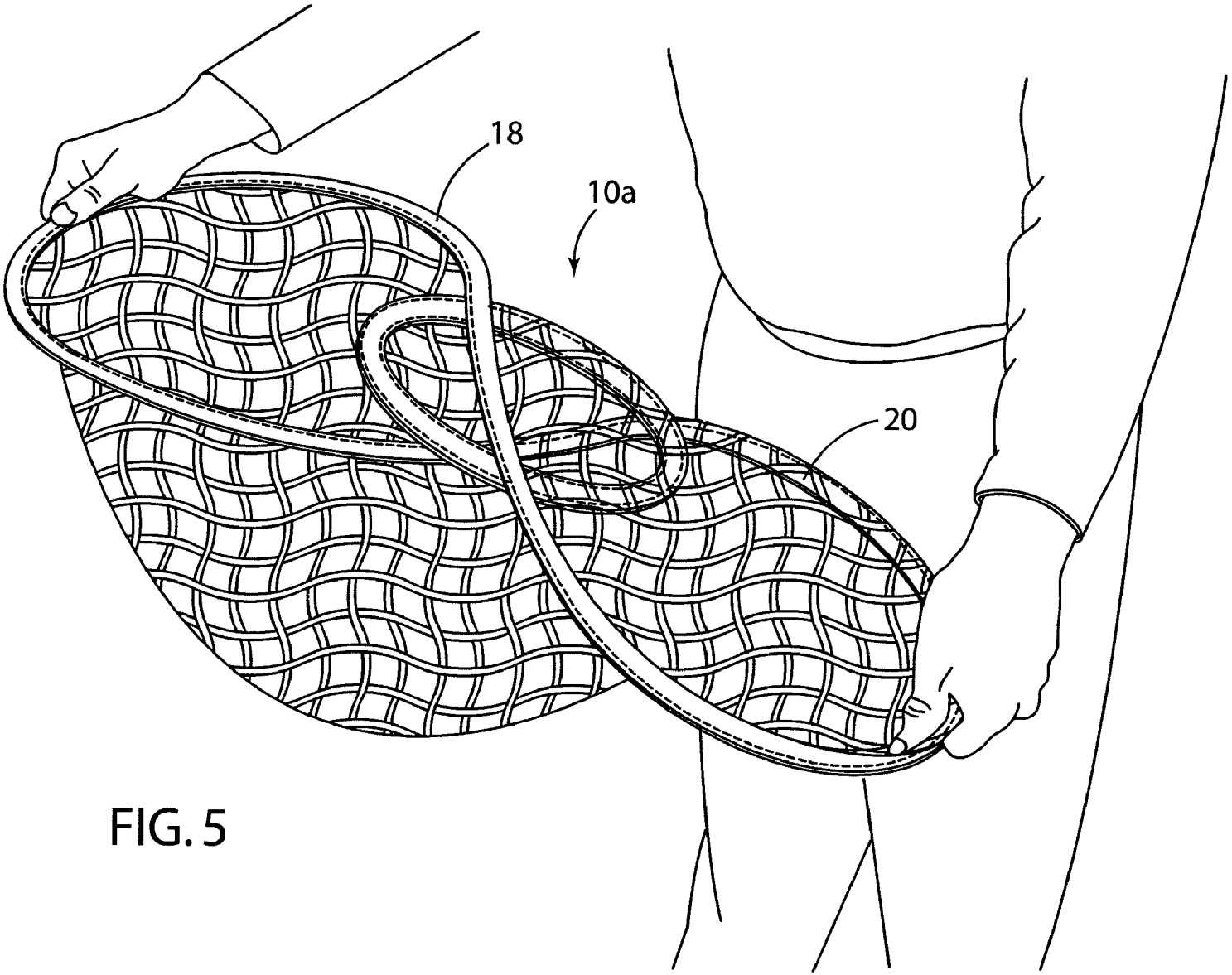
FIG. 5 is a perspective view of the chipping net in accordance with the present invention in a second stowing position.
Figure 6:
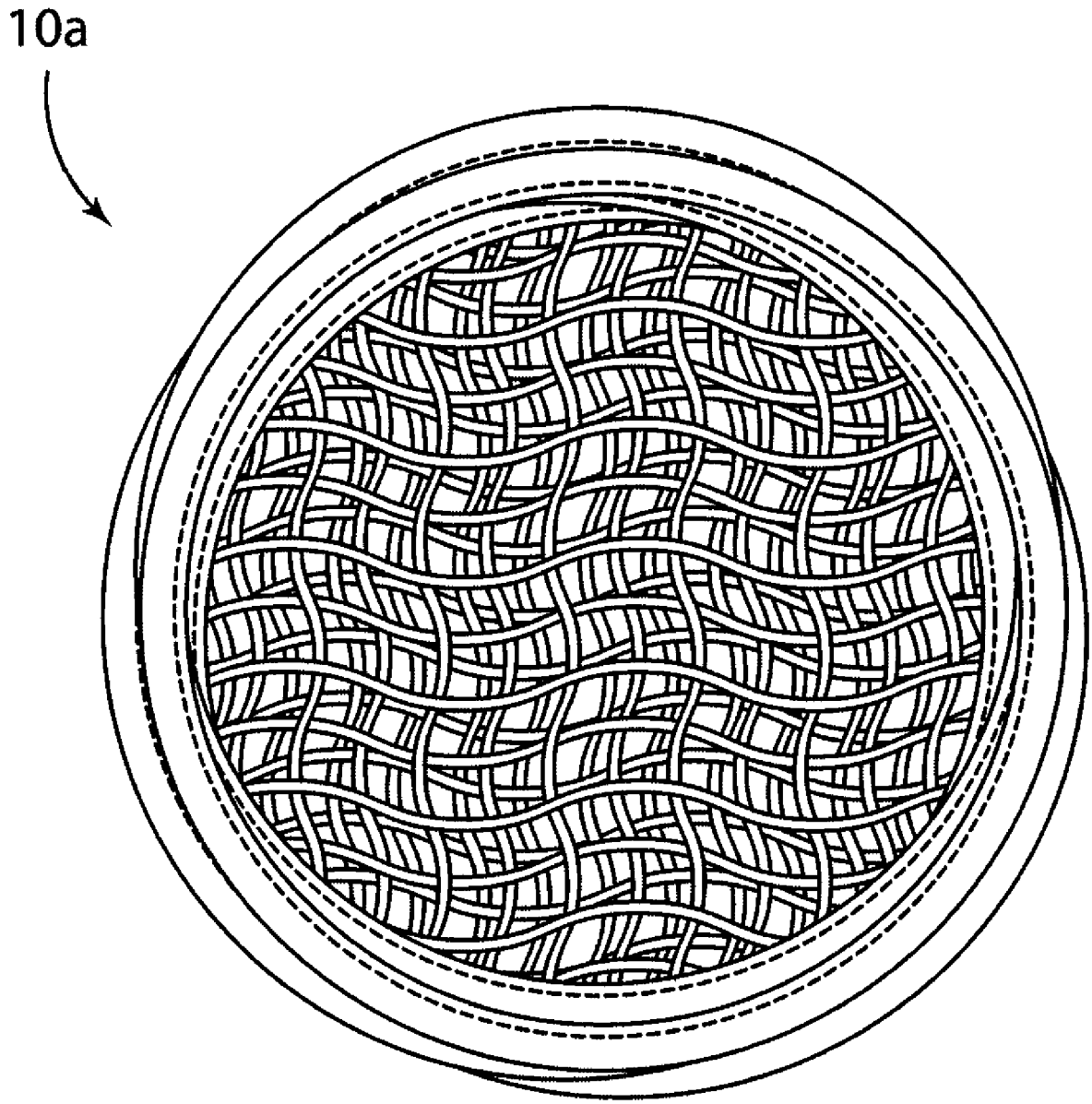
FIG. 6 is a perspective view of the chipping net in accordance with the present invention in a third stowing position.
Figure 7:
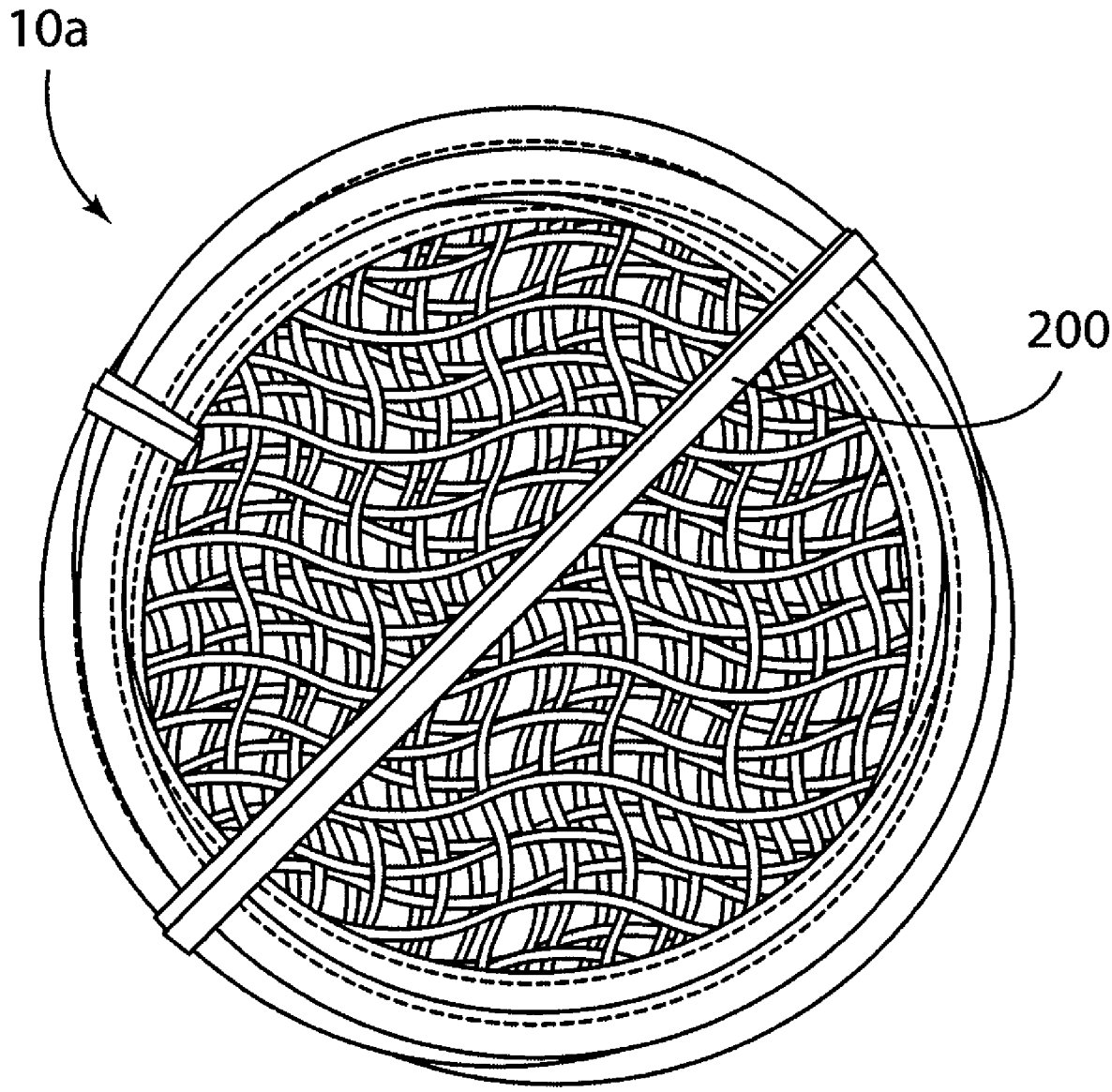
FIG. 7 is a perspective view of the chipping net in accordance with the present invention in a stowed position.

In the illustrated embodiment, the chipping nets 10 and 10*a* can be conveniently folded for storage as illustrated in FIGS. 4-7. As discussed below, the numbers from the first embodiment of the chipping net 10 are used, although the second embodiment of the chipping net 10*a* is stored in the same manner. First, if a supporting pole 34 is used, the supporting pole 34 is removed for the openings 29, 31 and removed from the rest of the chipping net 10, 10*a*. The upper portion 18 is then moved into a position adjacent the lower portion 20 as illustrated in FIG. 4, thereby forming a ring. The ring is then formed into a figure eight as illustrated in FIG. 5 and the two ends of the figure eight are folded about a crossing of the current figure eight to form a smaller circle as illustrated in FIG. 6. A band 200 is then placed over the smaller circle as illustrated in FIG. 7 to form the chipping net 10 into a small compact configuration for storage.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. A chipping net comprising:

a resilient but flexible rod formed into a figure eight and folded at a crossing of the figure eight, thereby forming a base loop for placement on a surface below the crossing and a main loop above the crossing, the main loop and the base loop being angled relative to each other, the angle being less than 90 degrees; and a net connected to the main loop for receiving golf balls;

wherein the force of the rod trying to expand into a circle out of the figure eight forces the main loop away from the base loop; and a strap connected to the main loop and the base loop preventing the main loop and the base loop from expanding the angle to be greater than a predetermined angle.

2. The chipping net of claim 1, further including:

a support rod for positively maintaining the main loop angled relative to the base loop.

3. The chipping net of claim 2, wherein:

the main loop includes a first aperture and the base loop includes a second aperture; and the support rod extends through the first aperture and the second aperture.

4. The chipping net of claim 1, wherein:

ends of the rod are connected to form the rod into a circle.

5. The chipping net of claim 1, further including:

a sheath covering the rod, the sheath forming a pair of circles, with each circle being connected at the crossing.

6. The chipping net of claim 5, wherein:

ends of the rod are adjacent to each other, but not connected.

7. The chipping net of claim 5, wherein:

the sheath includes a connection member at the crossing, thereby assisting in maintaining the rod in the figure eight.

8. The chipping net of claim 1, further including:

a target connected to the main loop, the target defining an area smaller than the main loop, thereby dividing an area within the main loop into a first ball receiving area and a second ball receiving area, the first ball receiving area being located between the main loop and the target and the second ball receiving area being located within the target.

9. The chipping net of claim 8, wherein:

the target has an auxiliary net connected thereto for receiving balls hit into the second ball receiving area.

10. The chipping net of claim 1, further including:

a band for maintaining the chipping net in a folded condition for storage.

11. A method of providing a chipping net comprising:

providing a resilient but flexible rod;

forming the rod into a figure eight;

folding the rod at a crossing of the figure eight, thereby forming a base loop for placement on a surface below the crossing and a main loop above the crossing, the main loop and the base loop being angled relative to each other, the angle being less than 90 degrees; and connecting a net to the main loop for receiving golf balls;

forcing the main loop away from the base loop with a force of the rod trying to expand into a circle out of the figure eight; and connecting a strap to the main loop and the base loop to prevent the main loop and the base loop from expanding the angle to be greater than a predetermined angle.

12. The method of providing a chipping net of claim 11, further including:

positively maintaining the main loop at the angle relative to the base loop with a support rod.

13. The method of providing a chipping net of claim 12, wherein:

the main loop includes a first aperture and the base loop includes a second aperture; and the support rod extends through the first aperture and the second aperture.

14. The method of providing a chipping net of claim 11, further including:

covering the rod with a sheath, the sheath forming a pair of circles, with each circle being connected at the crossing.

15. The method of providing a chipping net of claim 11, further including:

a target connected to the main loop, the target defining an area smaller than the main loop, thereby dividing an area within the main loop into a first ball receiving area and a second ball receiving area, the first ball receiving area being located between the main loop and the target and the second ball receiving area being located within the target, the target having an auxiliary net connected thereto for receiving balls hit into the second ball receiving area.

16. A chipping net comprising:

a resilient but flexible rod formed into a figure eight and folded at a crossing of the figure eight, thereby forming a base loop for placement on a surface below the crossing and a main loop above the crossing, the main loop and the base loop being angled relative to each other, the angle being less than 90 degrees;

a net connected to the main loop for receiving golf balls;

wherein the force of the rod trying to expand into a circle out of the figure eight forces the main loop away from the base loop;

a strap connected to the main loop and the base loop preventing the main loop and the base loop from expanding the angle to be greater than a predetermined angle;

a support rod for positively maintaining the main loop angled relative to the base loop;

wherein the main loop includes a first aperture and the base loop includes a second aperture and the support rod extends through the first aperture and the second aperture;

a sheath covering the rod, the sheath forming a pair of circles, with each circle being connected at the crossing.

17. The chipping net of claim 16, further including:

a target connected to the main loop, the target defining an area smaller than the main loop, thereby dividing an area within the main loop into a first ball receiving area and a second ball receiving area, the first ball receiving area being located between the main loop and the target and the second ball receiving area being located within the target.

18. The chipping net of claim 17, wherein:

the target has an auxiliary net connected thereto for receiving balls hit into the second ball receiving area.

* * * * *